US011925267B2

(12) United States Patent
Jung et al.

(10) Patent No.: US 11,925,267 B2
(45) Date of Patent: Mar. 12, 2024

(54) BED FRAME AND SUPPORT MEMBER FOR BED FRAME

(71) Applicant: Zinus Inc., Gyeonggi-do (KR)

(72) Inventors: Young Do Jung, Gyeonggi-do (KR); Doo Hwan Cha, Gyeonggi-do (KR)

(73) Assignee: ZINUS INC., Gyeonggi-Do (KR)

( * ) Notice: Subject to any disclaimer, the term of this patent is extended or adjusted under 35 U.S.C. 154(b) by 205 days.

(21) Appl. No.: 17/491,141

(22) Filed: Sep. 30, 2021

(65) Prior Publication Data

US 2023/0049345 A1 Feb. 16, 2023

Related U.S. Application Data

(63) Continuation of application No. PCT/CN2021/118595, filed on Sep. 15, 2021.

(30) Foreign Application Priority Data

Aug. 10, 2021 (CN) ..... 202110915071.4
Aug. 10, 2021 (CN) ..... 202121863494.8

(51) Int. Cl.
*A47C 19/12* (2006.01)
*A47C 19/02* (2006.01)

(52) U.S. Cl.
CPC ..... *A47C 19/12* (2013.01); *A47C 19/02* (2013.01)

(58) Field of Classification Search
CPC ..... A47C 19/12; A47C 19/02; A47C 19/122; A47C 19/024; A47C 19/128;
(Continued)

(56) References Cited

U.S. PATENT DOCUMENTS 1,599,971 A * 9/1926 Melson ..... E05C 17/30 292/265
4,048,683 A * 9/1977 Chen ..... A47C 19/122 5/174

(Continued)

FOREIGN PATENT DOCUMENTS

CN 201064311 Y 5/2008
CN 201384633 Y 1/2010

(Continued)

OTHER PUBLICATIONS

PCT/CN2021/118595 International Search Report and Written Opinion dated Apr. 26, 2022.

*Primary Examiner* — Myles A Throop
(74) *Attorney, Agent, or Firm* — Wilson Sonsini Goodrich & Rosati

(57) ABSTRACT

The present disclosure provides a foldable bed frame and associated methods for deploying the foldable bed frame. The bed frame may comprise one or more supporting members for supporting at least a portion of the bed frame, wherein the one or more supporting members comprise: a first bar comprising an opening; a second bar comprising a groove having a first end and a second end; and a locking mechanism comprising an elastic element and a pin. The pin may be inserted into (i) the opening of the first bar and (ii) the groove of the second bar to couple the first and second bars together. The first and second bars may be movable relative to each other when the pin is moved from a first position to a second position in response to a force applied to the elastic element.

20 Claims, 7 Drawing Sheets

(58) Field of Classification Search
CPC ..... A47B 2200/08; A47B 41/02; A47B 3/00; A47B 3/002; A47B 3/08
See application file for complete search history.

(56) References Cited

U.S. PATENT DOCUMENTS 5,429,413 A * 7/1995 Levy ..... A47C 19/126 297/16.2
5,953,778 A 9/1999 Hiatt
6,073,286 A * 6/2000 Wu ..... A47C 20/041 5/616
6,299,113 B1 * 10/2001 Yamashita ..... A47C 3/40 248/161
6,575,656 B2 * 6/2003 Suh ..... E04H 15/46 403/379.5
7,849,867 B2 * 12/2010 Takayama ..... E04H 15/60 135/114
7,874,303 B2 * 1/2011 Xie ..... E04H 15/46 135/120.3
11,666,140 B1 * 6/2023 Gruver ..... A47B 3/002 108/115
11,700,950 B2 * 7/2023 Choi ..... A47C 19/128 5/174
2006/0062632 A1 * 3/2006 Jang ..... F16B 7/105 403/378
2007/0012346 A1 * 1/2007 Choi ..... F16B 7/105 135/120.3
2007/0277317 A1 * 12/2007 Ferko ..... A61G 7/015 5/618
2010/0005587 A1 * 1/2010 Choi ..... A47C 19/122 5/202
2016/0166055 A1 * 6/2016 Bo ..... A47B 3/002 108/42
2017/0215598 A1 * 8/2017 Choi ..... A47C 19/04
2018/0000254 A1 * 1/2018 Jin ..... A47C 17/70
2019/0029435 A1 * 1/2019 Choi ..... A47C 19/128
2021/0062842 A1 * 3/2021 Chen ..... A47B 9/16

FOREIGN PATENT DOCUMENTS

CN 105852516 A 8/2016
CN 206102173 U 4/2017
CN 206151020 U 5/2017
CN 207886004 U 9/2018
CN 210077147 U 2/2020
CN 210330029 U 4/2020
CN 113545625 A 10/2021
CN 215936868 U 3/2022
DE 202015106737 U1 1/2016
WO WO-2019046892 A1 3/2019
WO WO-2023015666 A1 2/2023

* cited by examiner

BED FRAME AND SUPPORT MEMBER FOR BED FRAME

CROSS-REFERENCE

This application is a continuation application of International Application No. PCT/CN2021/118595, filed Sep. 15, 2021, which claims the benefit of and priority to Chinese Patent Application No. 202110915071.4 filed on Aug. 10, 2021 and Chinese Patent Application No. 202121863494.8 filed on Aug. 10, 2021, each of which is incorporated herein by reference in its entirety for all purposes.

BACKGROUND

Folding bed frames are easy to transport and deploy because they can be folded for carrying and/or storage and unfolded (i.e., deployed) once moved into an appropriate or desired area or environment. Folding bed frames may require one or more supporting structures (e.g., frames, bars, or other load-bearing members) to enhance frame support and stability during use.

SUMMARY

The present disclosure provides foldable bed frames and support members configured to provide enhanced support and stability for foldable bed frames. To improve support and stability, commercially available bed frames typically implement a support mechanism that may be bolted to a leg assembly of the bed frame and a portion of the foldable frame body. These bed frames over-complicate the folding and unfolding process by requiring (i) the installation of supporting mechanisms using various fasteners (e.g., bolts) before the bed frames can be used, and (ii) the removal of the supporting mechanisms prior to folding the bed frames, which requires manually undoing the fasteners in order to remove or decouple the supporting mechanisms from the leg assemblies and the frame.

Recognized herein are various limitations with bed frames currently available. The present disclosure aims to address the shortcomings and technical disadvantages of commercially available bed frames by providing a foldable bed frame that does not require additional tooling or labor to unfold (i.e., deploy) or fold a foldable bed frame with structural members that enhance the stability and load-bearing support of the bed frame when the bed frame is deployed (i.e., in an unfolded position). To achieve such enhancements, the bed frames of the present disclosure may utilize a folding bed frame support mechanism that can provide better stability when the bed frame is deployed, while providing consumers with a convenient means for adjusting the bed frame support mechanism to transition between (i) a locked configuration (which locks the support member to provide enhanced structural stability when the bed frame is deployed) and (ii) an unlocked configuration (which unlocks the support member to enable the bed frame to be folded for ease of transport and/or storage). The bed frames and supporting mechanisms disclosed herein may also permit folding and unfolding of bed frames without removing the support mechanism, thereby simplifying the process for unfolding and folding bed frames and also reducing the chance of misplacing the support mechanisms.

In one aspect, the present disclosure provides a bed frame. The bed frame may be a foldable bed frame. The foldable bed frame may comprise one or more supporting members for supporting at least a portion of the bed frame. The one or more supporting members may comprise a first bar comprising an opening, a second bar comprising a groove having a first end and a second end, and a locking mechanism comprising an elastic element and a pin. The pin may be inserted into (i) the opening of the first bar and (ii) the groove of the second bar to couple the first and second bars together. The first and second bars may be movable relative to each other when the pin is moved from a first position to a second position in response to a force applied to the elastic element.

In some embodiments, the pin is movable from the first end of the groove to the second end of the groove to extend the second bar relative to the first bar or to extend the first bar relative to the second bar once the pin is moved into or placed in the second position.

In some embodiments, the opening of the first bar or the groove of the second bar comprises an L-shaped opening or groove. In some embodiments, the first end of the groove is sized and shaped to permit the pin to move between the first position and the second position. In some embodiments, the first end of the groove is aligned with the opening of the first bar when the first and second bar are in a locked configuration relative to each other. In some embodiments, the first end of the groove comprises a same or similar size or shape as the opening of the first bar. In some embodiments, the first position and the second position are located at a same end of the groove of the second bar. In some embodiments, the groove comprises a cut out through the second bar. In some embodiments, the groove of the second bar is at least partially aligned with the opening of the first bar.

In some embodiments, the pin is configured to move into a third position when (i) the second bar is extended relative to the first bar or (ii) the first bar is extended relative to the second bar. In some embodiments, the third position is located (i) along a length of the groove of the second bar or (ii) at a different end of the groove of the second bar relative to the first and second positions.

In some embodiments, a width of the groove at the first end of the groove is different than a width of the groove at the second end of the groove. In some embodiments, the width of the groove at the first end of the groove is greater than a width of the groove at the second end of the groove to permit a movement of the pin between the first position and the second position.

In some embodiments, the first position restricts a movement of the first and second bars relative to each other. In some embodiments, the second position enables a movement of the first and second bars relative to each other.

In some embodiments, the elastic element has a spring constant that enables a movement of the pin from the second position to the first position, in absence of a force applied to the elastic element, when the pin is positioned at the first end of the groove.

In some embodiments, the locking mechanism further comprises a connector piece through which the pin is inserted. In some embodiments, the elastic element is positioned between the connector piece and the first or second bar. In some embodiments, the connector piece is movable between the first position and the second position. In some embodiments, the pin is configured to move from the first position to the second position when the connector piece is moved towards the first or second bar. In some embodiments, at least one end of the pin is riveted to the connector piece. In some embodiments, the connector piece and the pin are configured to move together such that the pin moves from the first position to the second position when the connector piece moves towards the first or second bar.

In some embodiments, the bed frame may further comprise a first sub-frame coupled to a second sub-frame, wherein the first sub-frame and the second sub-frame are movable relative to each other to fold or unfold the bed frame; and a first leg assembly coupled to the first sub-frame and a second leg assembly coupled to the second sub-frame, wherein the first leg assembly and the second leg assembly each comprise a lateral support bar. In some embodiments, the one or more supporting members comprise (i) a first end coupled to the lateral support bar of the first or second leg assemblies and (ii) a second end coupled to the first sub-frame or the second sub-frame.

In some embodiments, the first bar is movable along an axial length of the second bar. In some embodiments, the second bar is movable along an axial length of the first bar.

In another aspect, the present disclosure provides a method for deploying a bed frame. The method may comprise (a) providing a foldable bed frame comprising one or more supporting members for supporting at least a portion of the bed frame, wherein the one or more supporting members comprise: a first bar comprising an opening; a second bar comprising a groove having a first end and a second end; and a locking mechanism comprising an elastic element and a pin, wherein the pin is inserted into (i) the opening of the first bar and (ii) the groove of the second bar to couple the first and second bars together, wherein the first and second bars are movable relative to each other when the pin is moved from a first position to a second position in response to a force applied to the elastic element. In some embodiments, the method may further comprise (b) unfolding the foldable bed frame to provide a substantially flat surface. In some embodiments, the method may further comprise (c) unfolding a leg assembly of the foldable bed frame, wherein unfolding the leg assembly causes the pin to move into the first position, thereby locking the first and second bars together to restrict a relative movement of the first and second bars.

In some embodiments, the method may comprise, subsequent to (c), depressing the locking mechanism to counteract a spring force of the elastic element to move the pin from the first position to the second position. In some embodiments, moving the pin from the first position to the second position enables a relative movement of the first and second bars.

In some embodiments, the method may further comprise, subsequent to (c), folding the leg assembly, thereby moving the pin from the second position to a third position to (i) move the first bar relative to the second bar or (ii) move the second bar relative to the first bar. In some embodiments, moving the first and second bars relative to each other comprises (i) extending the first bar relative to the second bar or (ii) extending the second bar relative to the first bar.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "Figure" and "FIG." herein), of which:

DETAILED DESCRIPTION

Figure 1:
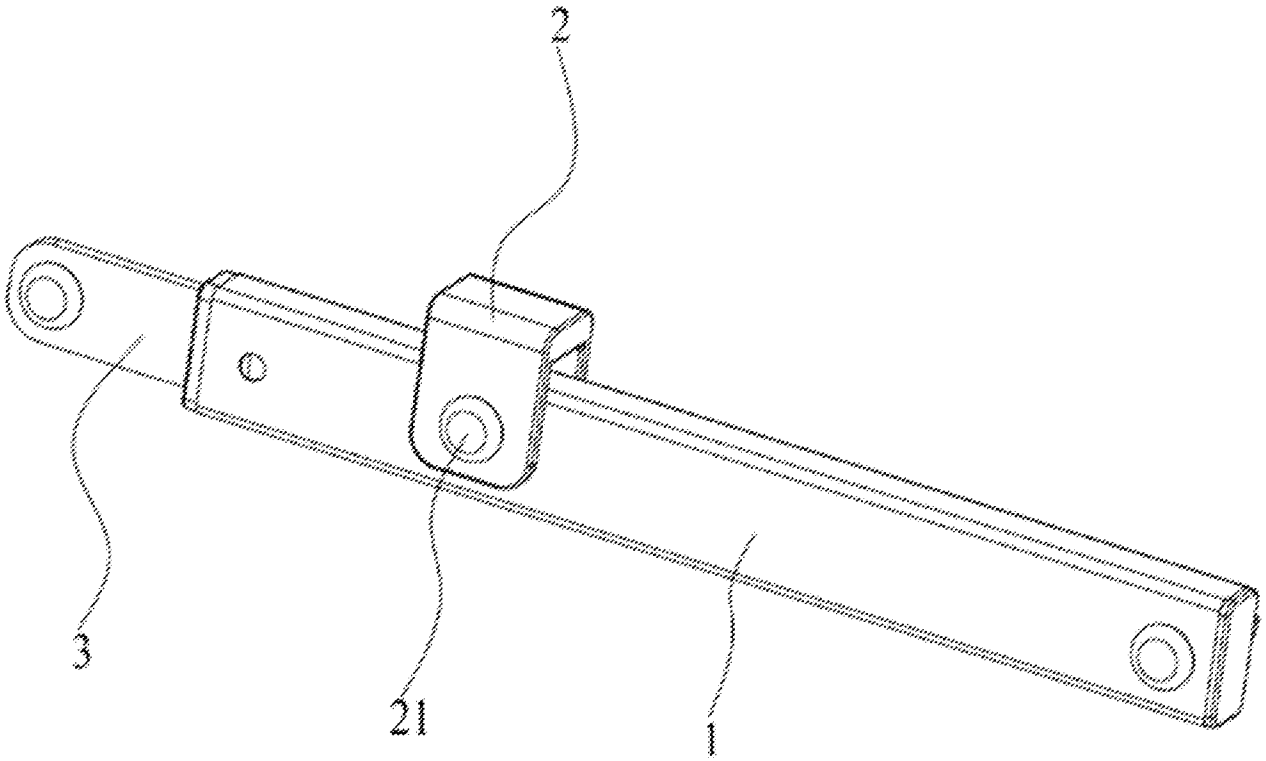
FIG. 1 schematically illustrates an exemplary supporting mechanism for a bed frame, in accordance with some embodiments.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

The present disclosure addresses the shortcomings and technical disadvantages of commercially available bed frames by providing a foldable bed frame that comprises one or more structural members configured to enhance the stability and load-bearing support of the foldable bed frame when the bed frame is deployed (i.e., in an unfolded position). The structural members may comprise a plurality of bars and a locking mechanism that permits the bars to be locked such that a relative movement of the bars is restricted. When the bars are in a locked configuration, the bars may collectively form a rigid support member extending from a leg assembly of the bed frame to a frame portion of the bed frame, which rigid support member is capable of supporting a load on the bed frame. The bars may be positioned and oriented such that a storage space underneath the bed frame and between the leg assemblies of the bed frame is maximized. The locking mechanism may be configured to release the bars from the locked configuration in response to a user-provided input, thereby placing the bars in an unlocked configuration that permits a relative movement of the bars. The relative movement of the bars may allow the leg assemblies and the bed frame to be folded into a compact configuration without restricting a movement of the leg assemblies or the bed frame to which the bars remain coupled or attached.

The bed frames disclosed herein may utilize one or more adjustable support members that can provide better stability and load bearing support when the bed frame is deployed, while providing consumers with a convenient means for adjusting the bed frame support members to transition between (i) a locked configuration (which locks the support member to provide enhanced structural stability when the bed frame is deployed) and (ii) an unlocked configuration (which unlocks the support member to enable the bed frame to be folded for ease of transport and/or storage). The bed frames and supporting members disclosed herein may also permit folding and unfolding of bed frames without removing the support members, thereby simplifying the process for unfolding and folding bed frames and also eliminating the possibility of misplacing the support members or any tools or fasteners typically required to secure support members to commercially available frames. The bed frames and support members of the present disclosure may not or need not require any additional tooling or unnecessary labor to unfold (i.e., deploy) or fold a foldable bed frame. This can help to simplify the process of folding and unfolding bed frames without comprising structural support or storage space.

Whenever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

Whenever the term "no more than," "less than," or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

Bed Frame

Figure 4:
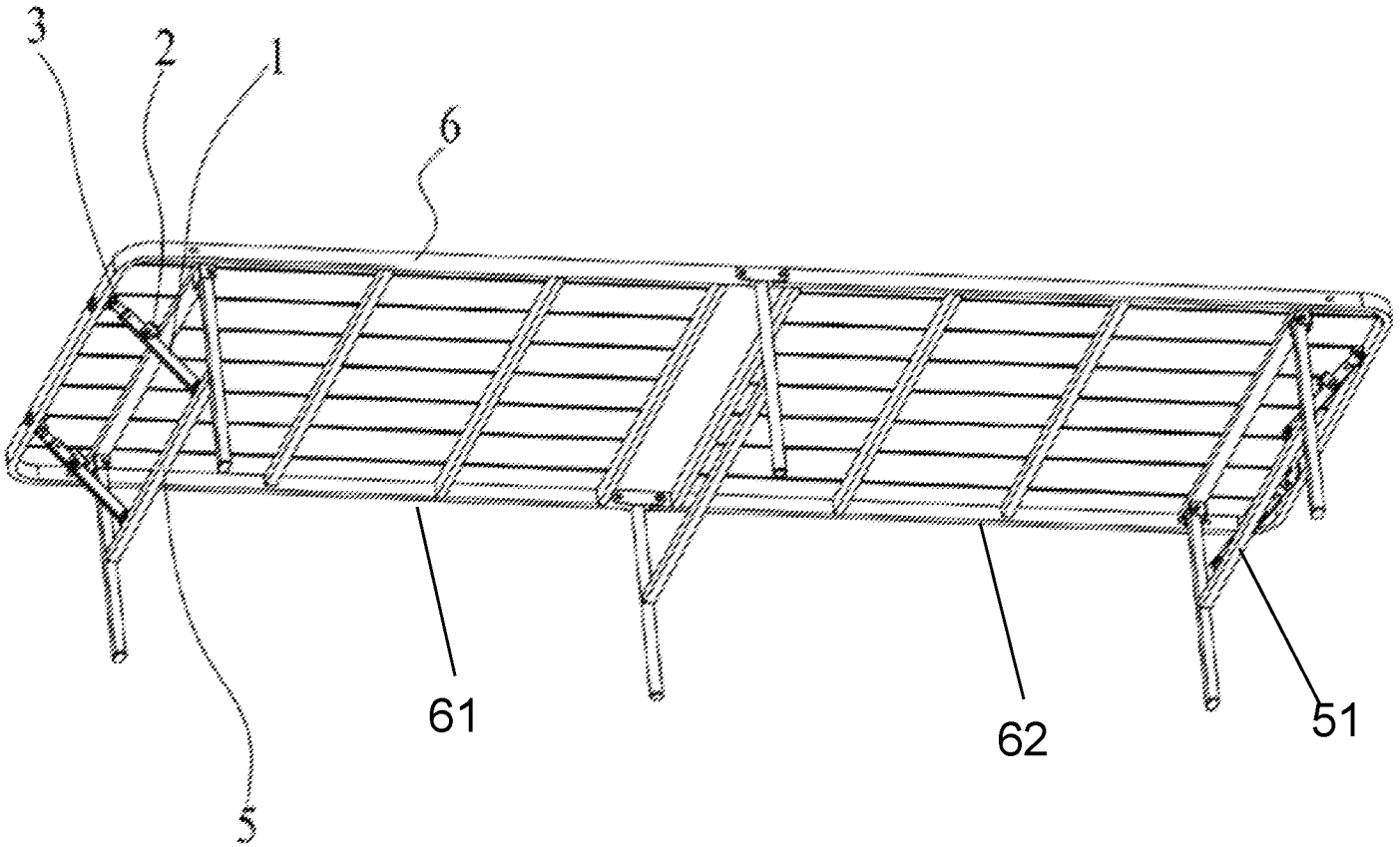
FIG. 4 schematically illustrates a foldable bed frame in an open (i.e., unfolded) state, in accordance with some embodiments.
Figure 5:
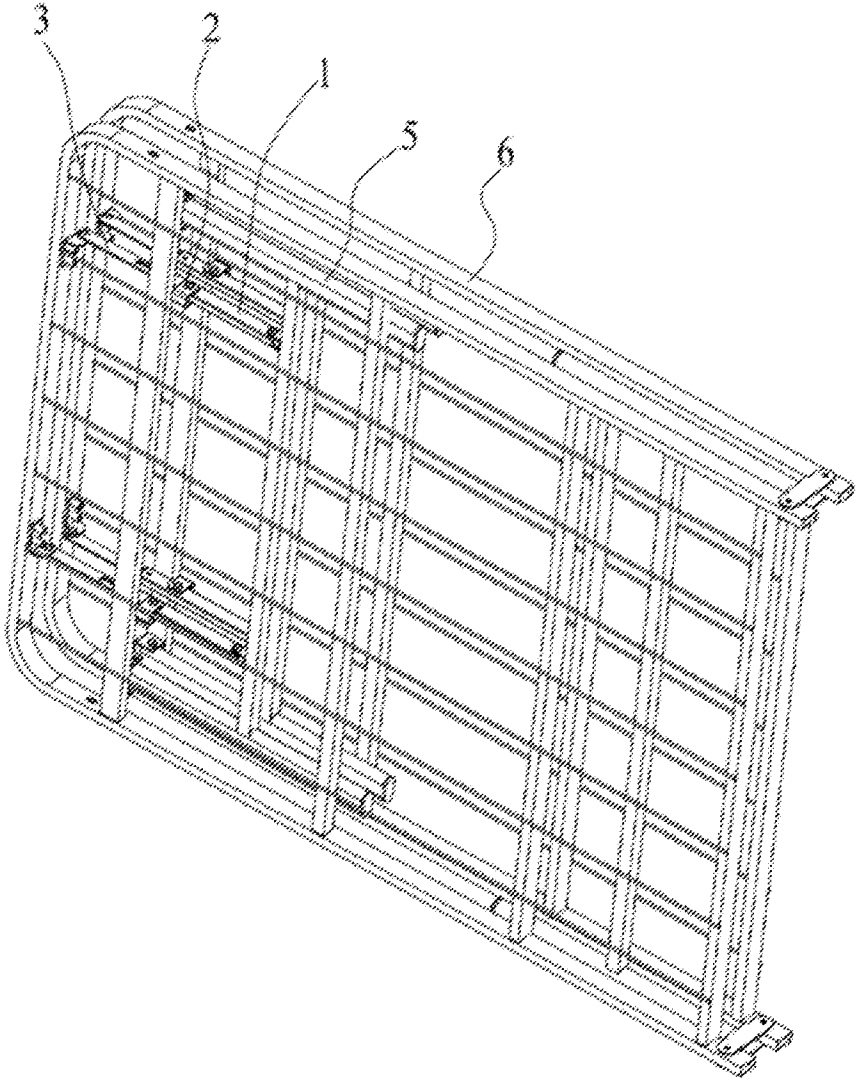
FIG. 5 schematically illustrates a foldable bed frame in a closed (i.e., folded) state, in accordance with some embodiments.

In an aspect, the present disclosure provides a foldable bed frame. An example of the foldable bed frame is illustrated in FIG. 4 and FIG. 5. FIG. 4 illustrates a foldable bed frame 6 in an unfolded configuration. FIG. 5 further illustrates the foldable bed frame 6 in a folded configuration. The foldable bed frame 6 may comprise one or more leg assemblies 5 that may be folded for storage and/or transport, or unfolded (i.e., deployed) to raise the bed frame 6 from the ground and to support a load on the bed frame 6. The foldable bed frame 6 may further comprise a supporting member comprising a first bar 1 and a second bar 3. The first bar 1 or the second bar 3 may be pivotably coupled or attached to (i) the leg assembly 5 at one end and (ii) a portion of the bed frame 6 (e.g., an edge portion or outer frame of the bed frame 6) at another end. The first bar 1 and the second bar 3 may be coupled to each other via a locking mechanism 2. As described elsewhere herein, the locking mechanism may permit a locking of the first bar 1 and the second bar 3 to restrict a relative movement of the first bar 1 and the second bar 3. The locking mechanism may also permit an unlocking of the first bar 1 and the second bar 3 to enable a relative movement of the first bar 1 and the second bar 3 (e.g., during folding of the leg assembly 5 or the bed frame 6).

The foldable bed frame may comprise a first sub-frame 61 coupled to a second sub-frame 62. The first sub-frame 61 and the second sub-frame 62 may be movable relative to each other to fold or unfold the bed frame. The bed frame may be folded for storage and/or transport. The bed frame may be unfolded or deployed for use (e.g., to support a mattress). In some embodiments, the foldable bed frame may comprise a first leg assembly coupled to the first sub-frame 61 and a second leg assembly coupled to the second sub-frame 62. The first leg assembly and the second leg assembly may each comprise a lateral support bar 51 extending from a first leg of the leg assembly to a second leg of the leg assembly. The lateral support bar 51 may provide structural rigidity for the first and second leg assemblies. When deployed, the bed frame may provide a substantially flat surface on which a mattress may be placed. The sub-frames and leg assemblies of the bed frame may be configured to support a load. The bed frame may provide a space underneath the sub-frames for organizing or storing various objects or items. The space may have a height corresponding to a height of the leg assemblies when the first and second leg assemblies are deployed to support the first and second sub-frames of the foldable bed frame. The space may have an area corresponding to an area of the foldable bed frame when the bed frame is unfolded or deployed. The area of the foldable bed frame may comprise a first area corresponding to an area of the first sub-frame 61 and a second area corresponding to an area of the second sub-frame 62. The area of the space underneath the bed frame may comprise the first area corresponding to the area of the first sub-frame 61 and the second area corresponding to the area of the second sub-frame 62.

Supporting Members

The foldable bed frame may comprise one or more supporting members for supporting at least a portion of the bed frame. The one or more supporting members may be configured to provide additional structural support and rigidity for one or more portions of the unfolded or deployed bed frame. In some cases, the one or more supporting members may provide additional structural support and rigidity for one or more portions of the unfolded or deployed bed frame which extend past the first leg assembly or the second leg assembly.

In some non-limiting embodiments, the one or more supporting members may comprise (i) a first end coupled to the lateral support bar of the first or second leg assemblies and (ii) a second end coupled to the first sub-frame or the second sub-frame. The second end of the one or more support members may be coupled to a portion of the first sub-frame or second sub-frame that extends beyond the first and second leg assemblies. This configuration can provide for additional storage space underneath the bed frame without compromising the structural support for the bed frame when the bed frame is unfolded or deployed.

In some cases, the one or more supporting members may comprise a first bar comprising an opening and a second bar comprising a groove having a first end and a second end. The first bar and/or the second bar may comprise any metallic or composite material, or any combination thereof.

The opening of the first bar may comprise, for example, a hole through the first bar. In some cases, the opening of the first bar may comprise a cut or slit through at least a portion of the first bar. The opening may be sized and shaped to receive a pin of a locking mechanism. In any of the embodiments described herein, the opening may provide a channel or passageway between a first portion or surface of the first bar and a second portion or surface of the first bar. The channel or passageway may permit an object (e.g., a pin or any other appropriately sized and shaped structural component) to pass through the first bar. In some cases, the channel or passageway may permit an object to be inserted into or through at least a portion of the first bar.

The groove of the second bar may comprise, for example, a cut out in or through the second bar. The cut out may extend at least partially through a thickness of the second bar. In some cases, the groove may comprise a cut out that extends all the way through the second bar. In other cases, the groove may comprise a cut out that only extends partially through the second bar. In some cases, the groove may comprise a slit or a slot within the second bar. The slit or slot may be sized and/or shaped to receive an object (e.g., a pin as described elsewhere herein). In some cases, the groove may comprise an opening through which a pin may be inserted (e.g., the pin of the locking mechanism as described elsewhere herein). In some cases, the groove may comprise a hole through which the pin may be inserted. In any of the embodiments described herein, the groove may permit an object (e.g., a pin or any other appropriately sized and shaped structural component) to pass through the second bar. In some cases, the groove may provide a channel or passageway that permits an object to be inserted into or through at least a portion of the second bar.

In some cases, the groove may comprise a first portion that extends along a first dimension of the second bar. In some cases, the groove may further comprise a second portion that extends along a second dimension of the second bar. The first dimension may correspond to a length of the second bar. The second dimension may correspond to a width of the second bar. The first portion of the groove and the second portion of the groove may form an angle. The angle may range from about 1 degree to about 179 degrees. In some cases, the first portion of the groove may be parallel or substantially parallel to an axis extending from a first end of the second bar to a second end of the second bar. In some cases, the second portion of the groove may be perpendicular or orthogonal to the axis extending from the first end of the second bar to the second end of the second bar.

Figure 6:
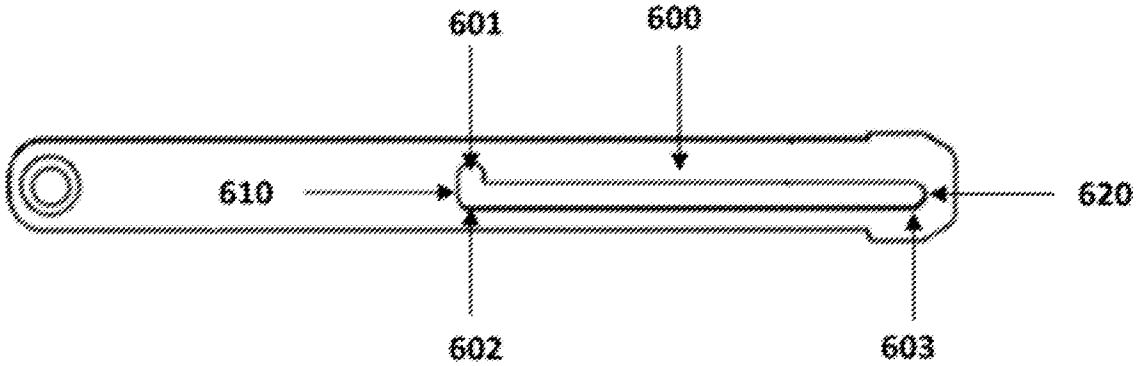
FIG. 6 schematically illustrates an inner bar of the supporting mechanism, in accordance with some embodiments.

The groove may comprise a variety of different shapes and sizes. For example, the groove may comprise a linear profile and/or a curved profile. In some cases, the groove may comprise a plurality of linear portions, a plurality of curved portions, or any combination of linear and curved portions. In some cases, the groove may comprise two or more linear portions that intersect or coincide with each other. The two or more linear portions may form, for example, an L-shaped groove as shown in FIG. 6. Alternatively, the two or more linear portions may form, in some non-limiting embodiments, a T-shaped groove. In any of the embodiments described herein, the groove may comprise any cross-sectional shape or profile. The cross-sectional shape or profile may comprise a regular shape or an irregular shape having three or more sides. The cross-sectional shape may not or need not be symmetrical. The cross-sectional shape or profile may comprise any combination of linear and non-linear portions or regions. In some cases, the cross-sectional shape may comprise rounded edges, chamfered edges, or filleted edges. In other cases, the cross-sectional shape may comprise one or more straight edges or corners.

In some cases, the groove of the second bar may be at least partially aligned with the opening of the first bar. Such alignment may permit an object (e.g., a pin of a locking mechanism) to be inserted through both the opening of the first bar and the groove of the second bar to couple the first and second bars together. In some cases, a portion of the groove (e.g., a first end of the groove) may comprise a same size and/or shape as the opening of the first bar.

In some cases, a first end of the groove may be aligned with the opening of the first bar when the first and second bars are in a locked configuration relative to each other. The first end of the groove may comprise a same or similar size or shape as the opening of the first bar. The groove of the second bar may be at least partially aligned with the opening of the first bar.

Locking Mechanism

In some cases, the one or more supporting members may further comprise a locking mechanism that is affixed to the first bar and/or the second bar. The locking mechanism may or may not be releasably coupled to the first bar and/or the second bar. The locking mechanism may not or need not be decoupled or detached from the first bar and/or the second bar in order to permit folding or unfolding of the foldable bed frame.

The locking mechanism may permit a user to selectively lock the first and second bars relative to each other to restrict a movement of the first bar relative to the second bar, or vice versa. The locking mechanism may automatically lock the first and second bars when a pin of the locking mechanism (described in greater detail below) moves into a predetermined position within the groove of the second bar. In some cases, the pin may naturally move into predetermined position when a user unfolds the leg assemblies of the foldable bed frame. The locking mechanism may permit a user to provide an input (e.g., a pushing force, or in some alternative embodiments, a pulling force or a rotational force) to unlock the first and second bars, thereby allowing a relative movement of the first and second bars. The locking mechanism may lock or restrict a movement of the first and second bars when the leg assemblies of the foldable bed frame are unfolded or deployed. The locking mechanism may permit a movement of the first and second bars when a user provides an input to unlock the locking mechanism and subsequently folds the leg assemblies of the foldable bed frame for storage and/or transport purposes.

The locking mechanism may provide several advantages over other commercially available locking mechanisms for bed frames. For instance, the locking mechanism may be configured to couple the first bar and the second bar together using a pin that is inserted through a body of the first bar and the second bar (e.g., via the opening of the first bar and the groove of the second bar). Inserting a pin through the body of the first bar and the second bar may provide a stronger and more reliable means for coupling the first and second bars together compared to other conventional locking mechanisms, which may attempt to couple bars together using a pin that is positioned within a notch or a slot disposed on an edge of a bar. The locking mechanism of the present disclosure may also reduce or eliminate the risk of the pin becoming dislodged or displaced due to an external force or movement, which may cause the first and second bars to move relative to each other and subsequently compromise structural rigidity and load bearing support even if the bed frame and the leg assemblies of the bed frame are fully deployed. As such, the locking mechanisms of the present disclosure may prevent a dangerous and potentially harmful scenario where a pin is dislodged and the bars of the support member are movable relative to each other, but the bed frame is still deployed (i.e., in an unfolded state) and a user has the incorrect impression or perception that the bed frame is still structurally stable and capable of supporting a load.

In some embodiments, the locking mechanism may comprise an elastic element and a pin. In some embodiments, the locking mechanism may comprise a connector piece that is configured to receive the pin. The pin may be riveted to the connector piece. The connector piece may comprise a U-shaped profile. The pin may be coupled, attached, or fastened to each side of the connector piece.

Elastic Element

As described above, the locking mechanism may comprise an elastic element. The elastic element may be positioned between the connector piece of the locking mechanism and the first and second bars. The elastic element may be compressed or stretched along an axis between the connector piece and the first and second bars. In some cases, the axis may be perpendicular or normal to a surface of the connector piece or a surface of the first or second bar. The elastic element may comprise a first portion that is in contact with the surface of the connector piece and a second portion that is in contact with the surface of the first or second bar.

The elastic element may comprise any component that flexes or deforms (e.g., in response to an initial force applied to at least a portion of the component) to provide a reactionary force that counteracts the initial force applied to the component. The elastic element may comprise, for example, a spring. The spring may comprise a compression spring, an extension spring, a torsion spring, a disc spring, a die spring, a strip spring, a rotor spring, a linear spring (e.g., a linear wave spring), or a gas spring.

Figure 7:
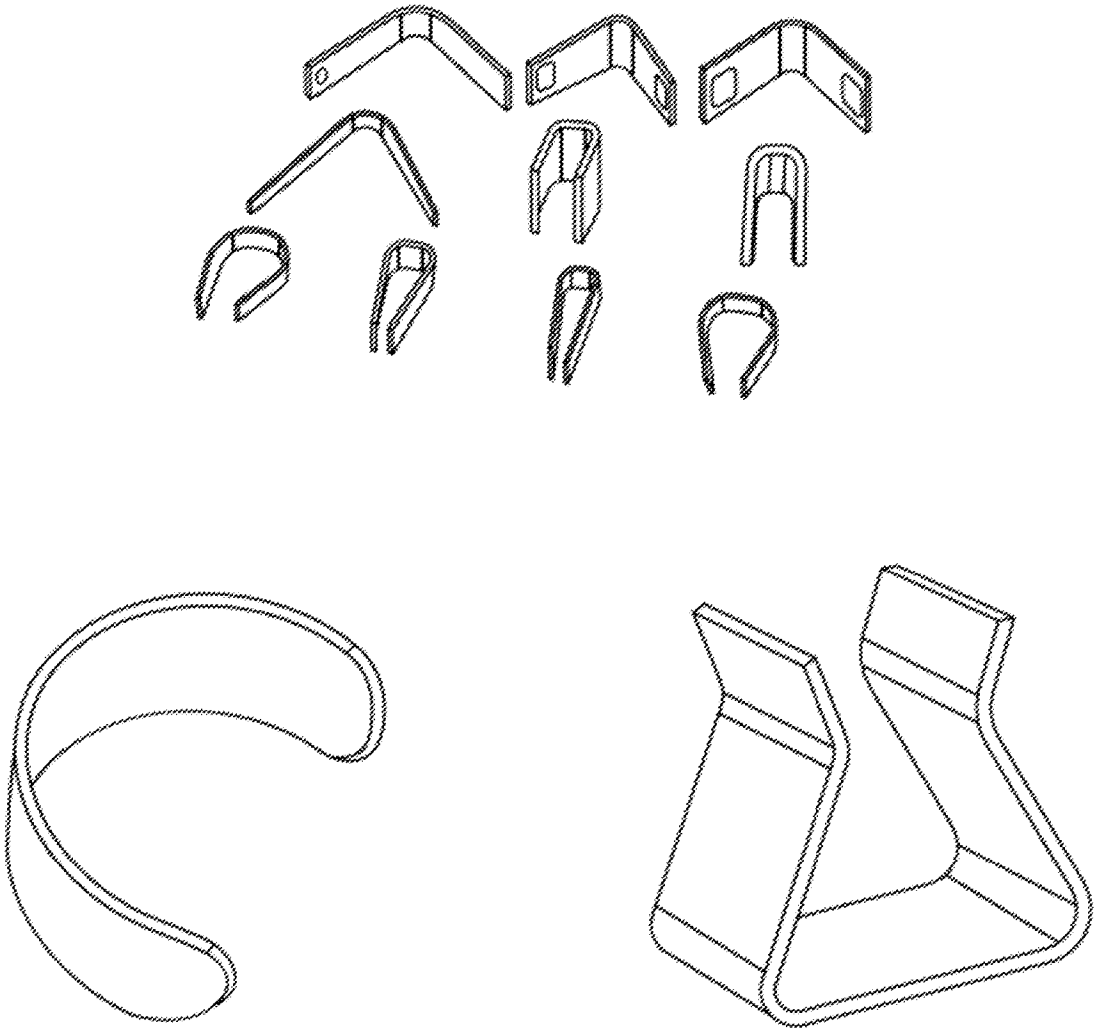
FIG. 7 schematically illustrates various examples of an elastic element that can be used for the locking mechanism, in accordance with some embodiments.

In some cases, the elastic element may comprise a strip of flexible material that is configured to flex and/or bend when a force is exerted on at least a portion of the flexible material. The flexible material may be formed from a spring steel wire, a spring steel strip, or a spring steel sheet. In some cases, the spring steel wire, the spring steel strip, or the spring steel sheet may be annealed or heat treated to form any shape with a desired set of material or mechanical properties. The material or mechanical properties may comprise, for example, elasticity, a force constant, or a Young's modulus. Various non-limiting examples of the elastic element are illustrated in FIG. 7.

Pin

As described above, the locking mechanism may comprise a pin. The pin may comprise an elongated component that is sized and shaped to be insertable through the opening of the first bar and/or the groove of the second bar. The pin may comprise any cross-sectional shape. For example, the pin may have a cross-sectional shape comprising a circle, an ellipse, an oval, or any polygon having three or more sides. In some non-limiting embodiments, the polygon may comprise a triangle, a square, a rectangle, a pentagon, a hexagon, a heptagon, or an octagon. In some cases, the cross-sectional shape may comprise one or more linear portions and/or one or more non-linear or curved portions. In some embodiments, the pin may comprise a cylindrical shape or profile. Each end of the pin may be affixed or attached to a connector piece of the locking mechanism, as described in greater detail below.

The pin of the locking mechanism may be inserted into (i) the opening of the first bar and (ii) the groove of the second bar to couple the first and second bars together. The first and second bars may be movable relative to each other when the pin is moved from a first position to a second position in response to a force applied to the elastic element.

FIG. 6 illustrates an example of an opening or a groove 600 that may be provided on the first bar or the second bar. In some cases, the groove may comprise a first portion that extends longitudinally along a first dimension of the second bar. In some cases, the groove may further comprise a second portion that extends along a second dimension of the second bar. The first dimension may correspond to a length of the second bar. The second dimension may correspond to a width of the second bar.

In some cases, the first portion of the groove and the second portion of the groove may form an angle. The angle may range from about 1 degree to about 179 degrees. In some cases, the first portion of the groove may be parallel or substantially parallel to an axis extending from a first end of the second bar to a second end of the second bar. In some cases, the second portion of the groove may be perpendicular or orthogonal to the axis extending from the first end of the second bar to the second end of the second bar.

The groove may comprise a variety of different shapes and sizes. For example, the groove may comprise a linear profile and/or a curved profile. In some cases, the groove may comprise a plurality of linear portions, a plurality of curved portions, or any combination of linear and curved portions. In some cases, the groove may comprise two or more linear portions that intersect or coincide with each other. The two or more linear portions may form, for example, an L-shaped groove as shown in FIG. 6. Alternatively, the two or more linear portions may form, in some non-limiting embodiments, a T-shaped groove.

In any of the embodiments described herein, the groove may comprise any cross-sectional shape or profile. The cross-sectional shape or profile may comprise a regular shape or an irregular shape having three or more sides. The cross-sectional shape may not or need not be symmetrical. The cross-sectional shape or profile may comprise any combination of linear and non-linear portions or regions. In some cases, the cross-sectional shape may comprise rounded edges, chamfered edges, or filleted edges. In other cases, the cross-sectional shape may comprise one or more straight edges or corners.

In some embodiments, the opening of the first bar or the groove of the second bar may comprise an L-shaped opening or groove. The L-shaped opening or groove may comprise a first portion that extends along a longitudinal length of the second bar and a second portion that is perpendicular to the first portion. In some cases, the opening of the first bar or the groove of the second bar may comprise a T-shaped opening or groove. The T-shaped opening or groove may comprise a first portion that extends along a longitudinal length of the second bar and a second portion that is perpendicular to the first portion. In some cases, the groove of the second bar may comprise a longitudinal portion and one or more portions that are disposed at an angle relative to the longitudinal portion. The one or more portions that are disposed at an angle relative to the longitudinal portion may comprise two or more portions that are distributed or arranged along a length of the longitudinal portion. In some cases, the two or more portions that are disposed at an angle relative to the longitudinal portion may be (i) positioned along different portions or regions of the longitudinal portion and/or (ii) angled at different orientations relative to the longitudinal portion. In other cases, the two or more portions that are disposed at an angle relative to the longitudinal portion may be (i) positioned along a same portion or region of the longitudinal portion and/or (ii) angled at a same orientation relative to the longitudinal portion. In some cases, the two or more portions that are disposed at an angle relative to the longitudinal portion may be configured to lock the first and second bars in different positions such that the first and second bars span different extensions lengths. In some cases, the one or more portions that are disposed at an angle relative to the longitudinal portion may be perpendicular to the longitudinal portion. The one or more portions that are disposed at an angle relative to the longitudinal portion may provide a secluded region (e.g., a region that is remote from the longitudinal portion) in which the pin may be locked into place, thereby preventing (i) the pin from moving or sliding along the longitudinal portion and (ii) a relative movement of the first and second bars of the support member.

The groove 600 may comprise a first end 610 and a second end 620. The first end 610 of the groove 600 may be sized and shaped to permit the pin to move between a first position 601 and a second position 602. The groove may be sized and shaped to permit the pin to move between a first position 601, a second position 602, and a third position 603. The first position 601 and the second position 602 may be located at a same end of the groove 600. For instance, the first position 601 and the second position 602 may be located on the first end 610 of the groove 600. The third position 603 may be located on the second end 620 of the groove 600. In some alternative cases, the third position 603 may be located along a length of the groove 600, between the first end 610 of the groove and the second end 620 of the groove.

When the pin is placed in the first position 601, the movement of the first and second bars may be restricted. This may correspond to a locked position for the first and second bars. The first and second bars may be placed in the locked position when the leg assemblies of the foldable bed frame are deployed, extended, or unfolded from an folded position.

In some cases, the pin may be moved from the first position 601 to the second position 602, for instance, when the locking mechanism is depressed and the elastic element is compressed. Once the pin is placed in the second position 602, the pin may be movable along a length of the groove 600. The first and second bars may then move relative to each other. Once the pin is moved into or placed in the second position 602, the pin may be movable from the first end of the groove to the second end of the groove to (i) extend the second bar relative to the first bar and/or (ii) extend the first bar relative to the second bar.

In some embodiments, the pin may be configured to move into a third position when (i) the second bar is extended relative to the first bar or (ii) the first bar is extended relative to the second bar. The third position may be located (i) along a length of the groove of the second bar or (ii) at a different end of the groove of the second bar relative to the first and second positions.

In some cases, the elastic element may be configured to move the pin from the second position 602 to the first position 601 in absence of any force applied to the elastic element. The elastic element may have a linear or non-linear force constant (e.g., a spring constant) that naturally moves the pin from the second position 602 to the first position 601 such that the pin moves into the first position 601 by default to lock and restrict a movement of the first and second bars relative to each other. In some embodiments, the elastic element may have a spring constant that enables a movement of the pin from the second position to the first position, in absence of a force applied to the elastic element, when the pin is positioned at the first end of the groove.

In any of the embodiments described herein, the first position may restrict a movement of the first and second bars relative to each other, and the second position may enable a movement of the first and second bars relative to each other. In any of the embodiments described herein, the first bar may be movable along an axial length of the second bar when the pin is placed in the second position. Alternatively, the second bar may be movable along an axial length of the first bar when the pin is placed in the second position.

In some embodiments, a width of the groove at the first end of the groove may be different than a width of the groove at the second end of the groove. In some cases, the width of the groove at the first end of the groove may be greater than a width of the groove at the second end of the groove to permit a movement of the pin between the first position and the second position.

Connector Piece

In some embodiments, the locking mechanism may further comprise a connector piece through which the pin may be inserted. The connector piece may comprise a U-shaped profile with a top or bottom surface and two side surfaces. In some cases, the elastic element may be positioned between the connector piece and the first or second bar.

In some cases, the connector piece may be rigidly connected to the pin such that the pin and the connector piece move together as a single component. For instance, at least one end of the pin may be riveted to the connector piece. In such cases, the pin and/or the connector piece may be collectively movable between the first position and the second position when a user manipulates the connector piece (e.g., by pressing down on the connector piece, which may exert a force on the elastic element that depresses the elastic element). In some cases, the pin and/or the connector piece may be collectively movable between the second position and the third position (e.g., when the first bar is extended relative to the second bar, or vice versa). In some embodiments, the pin may be configured to move from the first position to the second position when the connector piece is moved towards the first or second bar. In some cases, the connector piece and the pin may be configured to move together such that the pin moves from the first position to the second position when the connector piece moves towards the first or second bar.

Methods of Use

In another aspect, the present disclosure provides a method for deploying a bed frame. The method may comprise (a) providing a foldable bed frame. The foldable bed frame may comprise one or more supporting members for supporting at least a portion of the bed frame. The one or more supporting members may comprise a first bar comprising an opening; a second bar comprising a groove having a first end and a second end; and a locking mechanism comprising an elastic element and a pin. As described elsewhere herein, the pin may be inserted into (i) the opening of the first bar and (ii) the groove of the second bar to couple the first and second bars together. In some cases, the first and second bars may be movable relative to each other when the pin is moved from a first position to a second position in response to a force applied to the elastic element.

In some embodiments, the method may further comprise (b) unfolding the foldable bed frame to provide a substantially flat surface. Unfolding the foldable bed frame may comprise moving a first sub-frame relative to a second sub-frame (or vice versa) to provide a flat surface that is formed by the first sub-frame and the second sub-frame. The flat surface may comprise the first sub-frame placed adjacent to the second sub-frame such that the first sub-frame and the second sub-frame lie on a same plane. The first sub-frame and the second sub-frame may be pivotably coupled to each other, either directly or via a connecting member. Such pivotable coupling may permit an angular orientation between the first sub-frame and the second sub-frame during folding or unfolding of the foldable bed frame.

In some embodiments, the method may further comprise (c) unfolding a leg assembly of the foldable bed frame. Unfolding the leg assembly may cause the pin to move into the first position, thereby locking the first and second bars together to restrict a relative movement of the first and second bars.

In some embodiments, the method may further comprise, subsequent to (c), depressing the locking mechanism to counteract a spring force of the elastic element to move the pin from the first position to the second position. In some cases, moving the pin from the first position to the second position may enable a relative movement of the first and second bars. In some embodiments, the method may further comprise folding at least one of the one or more leg assemblies, thereby moving the pin from the second position to a third position to (i) move the first bar relative to the second bar or (ii) move the second bar relative to the first bar. In some cases, moving the first and second bars relative to each other may comprise (i) extending the first bar relative to the second bar or (ii) extending the second bar relative to the first bar.

FIG. 1 schematically illustrates an example of a supporting member for a foldable bed frame. The supporting member may comprise a first bar 1 and a second bar 3. The supporting member may further comprise a locking mechanism 2 comprising a connector piece and a pin 21 that is inserted through the connector piece 2. The pin 21 may also be inserted through an opening 11 of the first bar and a groove 31 of the second bar to couple the first and second bars together. The pin 21 may be riveted to the connector piece on each side 23 of the connector piece.

Figure 2:
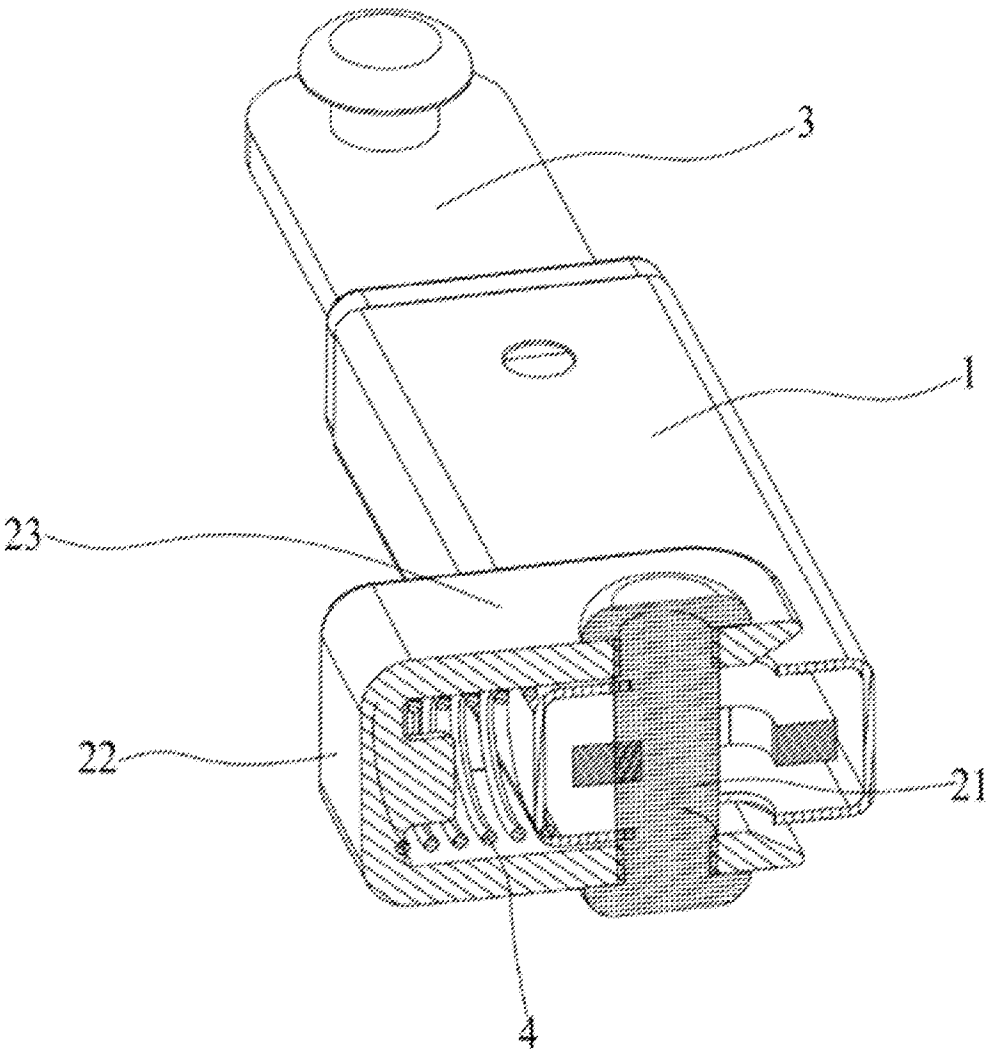
FIG. 2 schematically illustrates a cross-sectional view of an exemplary supporting mechanism for a bed frame, in accordance with some embodiments.

As shown in FIG. 2, the locking mechanism 2 may further comprise an elastic element 4 disposed between the connector piece and the first and second bars. The elastic element 4 may comprise a compression spring. In some embodiments, the connector piece may comprise a U-shaped profile formed by a bottom portion 22 of the connector piece and the side portions 23 of the connector piece. In some cases, the connector piece may comprise a raised or extruded portion that is interior to the connector piece and adjacent to the bottom portion 22 of the connector piece. In some cases, the spring element 4 may be seated on the raised or extruded portion interior to the connector piece.

Figure 3:
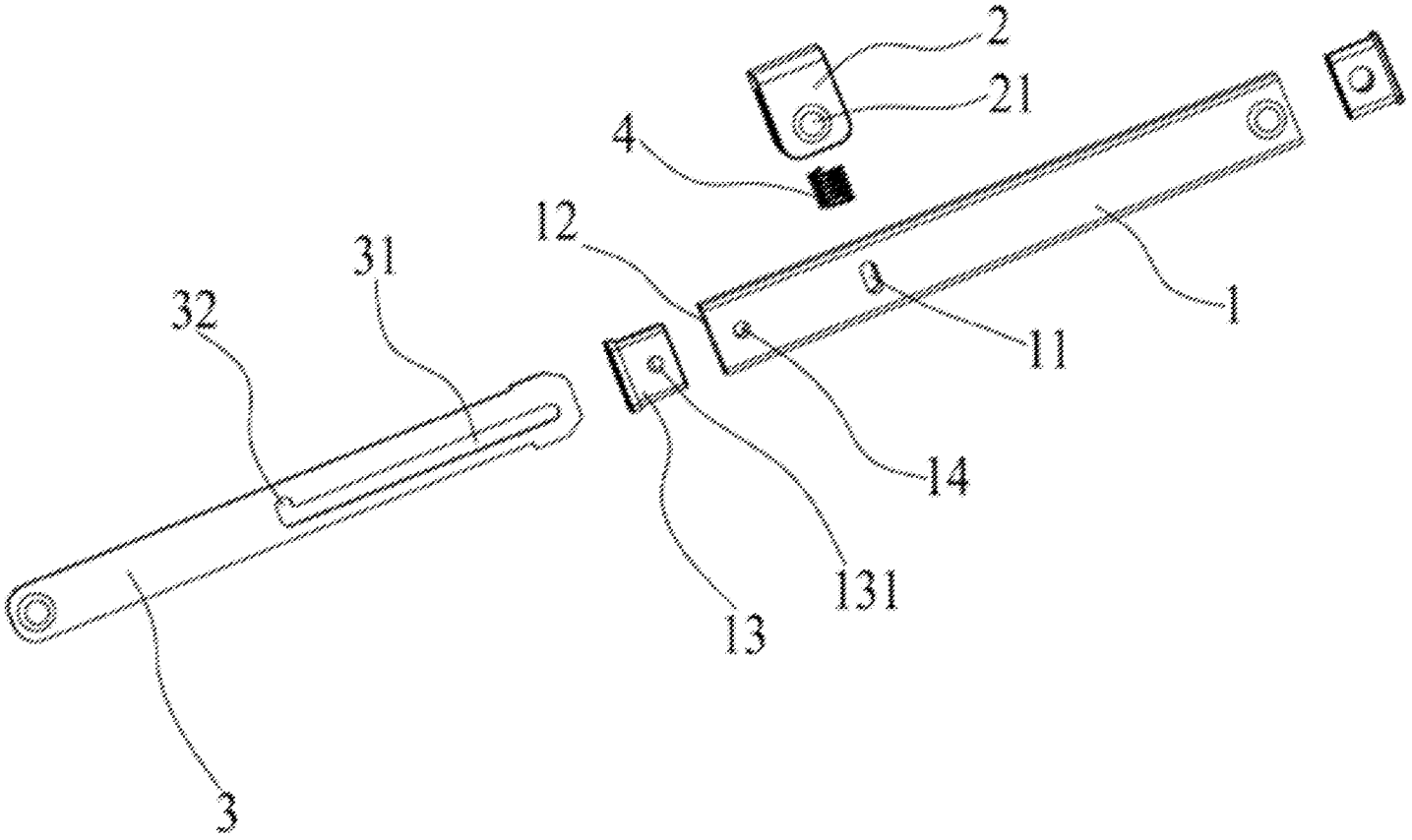
FIG. 3 schematically illustrates a locking mechanism for a supporting mechanism of a bed frame, in accordance with some embodiments.

FIG. 3 schematically illustrates an exploded view of the supporting members disclosed herein. The supporting members may comprise a first bar 1 comprising an opening 11. In some embodiments, the first bar 1 may be hollow. The first bar 1 may comprise an inner volume through which the second bar 3 may be inserted. When inserted into the first bar 1, the second bar 3 may be movable (e.g., slidable) relative to the first bar 1. In some cases, the second bar 3 may comprise a plate that is insertable into the inner volume of the first bar 1.

In some cases, an end piece 13 may be inserted into and/or coupled to the end 12 of the first bar 1, and the second bar 3 may be inserted into the first bar 1 via the end piece 13. The end piece 13 may comprise a protrusion 131 that is configured to couple to the first bar 1 when the protrusion 131 is placed within a hole 14 on a side wall of the first bar 1. The hole 14 on the side wall of the first bar 1 may be configured to receive the protrusion 131, thereby restricting a movement of the end piece 13 relative to the first bar 1. The end piece 13 may comprise an opening that provides access to the inner volume of the first bar 1. The end piece may provide additional stability for the second bar 3 to slide relative to the first bar 1 without shaking or unnecessary movement in other unintended directions.

In some embodiments, the second bar 3 may comprise a groove 31. In some non-limiting embodiments, the groove 31 may comprise an L-shaped groove. The groove 31 may comprise a slot 32 that is configured to receive the pin 21 of the locking mechanism 2. The slot 32 may lock or restrict a movement of the pin 21 when the pin is inserted into the slot 32. The slot 32 may correspond to the first position on a first end of the groove, as described elsewhere herein. The pin 21 may be in an unlocked state when the pin 21 is movable along the length of the groove 31. The unlocked state may permit an extension of the first bar 1 relative to the second bar 3. When the pin 21 is positioned at the end of the groove 31 where the slot 32 is located, the elastic element 4 may cause the pin 21 to move up into the slot 32 into a locked state. The locked state may provide additional support and stability for the foldable bed frame when the bed frame is deployed. In any of the embodiments described herein, the locked state may correspond to a configuration in which the leg assemblies of the foldable bed frame are completely deployed, and the unlocked state may correspond to a configuration in which the leg assemblies of the foldable bed frame are folded or are being folded by a user. The locking mechanism and the supporting member may permit folding and unfolding of the bed frame and the leg assemblies without requiring (i) a separate installation step to fasten the supporting member to the bed frame for additional support or stability after the bed frame is deployed or (ii) a separate disassembly step to unfasten the supporting member from the bed frame before folding the bedframe and leg assemblies.

In some cases, the groove 31 may comprise an elongated cutout that extends along a first direction, which first direction may correspond to a length of the second bar 3. In some cases, the slot 32 at the first end of the groove may extend in a second direction that is different than the first direction. In some cases, the first direction and the second direction may be disposed at an angle relative to each other. The angle may range from about 1 degree to about 179 degrees.

FIG. 4 schematically illustrates an example of a foldable bed frame 6 comprising a plurality of supporting members. Each of the supporting members may comprise a first bar 1, a second bar 3, and a locking mechanism 2. In some cases, one of the first bar or the second bar may be attached or coupled to a portion of the foldable bed frame 6, and the other of the first bar or the second bar may be attached or coupled to a leg assembly 5 of the foldable bed frame 6. The first bar and/or the second bar may be attached or coupled to the bed frame 6 or the leg assembly 5 using a hinged connector. The hinged connector may permit an angular displacement of the supporting member relative to the bed frame 6 and/or the leg assembly 5 when at least one of the bed frame 6 or the leg assembly 5 is articulated.

As shown in FIG. 4, when the leg assembly 5 is fully deployed relative to the foldable frame 6 (i.e., capable of supporting a maximum rated load), the second bar 3 may be partially inserted into the first bar 1 such that the first bar 1 and the second bar 3 span a first length. Further, the pin 21 of the locking mechanism 2 may slide along the length of the groove (e.g., from a second end of the groove to a first end of the groove where the slot 32 is located) and slide into the slot 32 (also referred to herein as the first position). The movement of the pin 21 into the slot 32 may be effected by the elastic element 4. Once the pin is positioned into the slot 32, the first and second bar may be locked relative to each other, thereby restricting a relative movement of the bars while providing improved stability for the bed frame.

As shown in FIG. 5, when the leg assembly 5 is folded or being folded relative to the bed frame 6, the second bar 3 may extend relative to the first bar 1 such that the first bar 1 and the second bar 3 span a second length. The second length may be greater than the first length referenced above. The leg assembly 5 may be folded when a user exerts a force on the elastic element of the locking mechanism 2 to move the pin 21 out of the slot 32 (also referred to herein as the first position on the groove) into the second position on the groove. Once the pin is removed from the slot 32 and placed in the second position, the first and second bars may be unlocked relative to each other, thereby enabling a relative movement of the bars to facilitate folding of the leg assembly 5.

As described above, the design and configuration of the locking mechanism and the support members may permit the bars to be locked such that a relative movement of the bars is temporarily restricted. When the bars are in a locked configuration, the bars may collectively form a rigid support member extending from a leg assembly of the bed frame to a frame portion of the bed frame, which rigid support member is capable of supporting a load on the bed frame. The bars may be positioned and oriented such that a storage space underneath the bed frame and between the leg assemblies of the bed frame is maximized. The locking mechanism may be configured to release the bars from the locked configuration in response to a user-provided input, thereby placing the bars in an unlocked configuration that permits a relative movement of the bars. The relative movement of the bars may allow the leg assemblies and the bed frame to be folded into a compact configuration without restricting a movement of the leg assemblies or the bed frame to which the bars remain coupled or attached.

The adjustable support members may provide better stability and load bearing support when the bed frame is deployed, while providing consumers with a convenient means for adjusting the bed frame support members to transition between (i) a locked configuration (which locks the support member to provide enhanced structural stability when the bed frame is deployed) and (ii) an unlocked configuration (which unlocks the support member to enable the bed frame to be folded for ease of transport and/or storage). The bed frames and supporting members disclosed herein may also permit folding and unfolding of bed frames without removing the support members, thereby simplifying the process for unfolding and folding bed frames and also eliminating the possibility of misplacing the support members or any tools or fasteners typically required for commercially available frames. The bed frames and support members of the present disclosure may not or need not require any additional tooling or unnecessary labor to unfold (i.e., deploy) or fold a foldable bed frame. This can help to simplify the process of folding and unfolding bed frames without comprising structural support or storage space.

The locking mechanism may also provide several distinct advantages over other commercially available locking mechanisms for bed frames. For instance, the locking mechanism may be configured to couple the first bar and the second bar together using a pin that is inserted through a body of the first bar and the second bar (e.g., via the opening of the first bar and the groove of the second bar). Inserting a pin through the body of the first bar and the second bar may provide a stronger, safer, and more secure and reliable means for coupling the first and second bars together compared to other conventional locking mechanisms (which may attempt to couple bars together using a pin that is positioned within a notch or a slot disposed on an edge of a bar). The locking mechanism of the present disclosure may also reduce or eliminate the risk of the pin becoming dislodged or displaced due to an external force or movement, which may cause the first and second bars to move relative to each other and subsequently compromise structural rigidity and load bearing support even if the bed frame and the leg assemblies of the bed frame are fully deployed. As such, the locking mechanisms of the present disclosure may prevent a dangerous and potentially harmful scenario where a pin is dislodged and the bars of the support member are movable relative to each other, but the bed frame is still deployed (i.e., in an unfolded state), which can give a user the incorrect impression or perception that the bed frame is structurally stable and capable of safely supporting a load.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. A bed frame comprising:

one or more supporting members for supporting at least a portion of the bed frame, wherein the one or more supporting members comprise:

a first bar comprising an opening;

a second bar comprising a groove having a first end and a second end; and a locking mechanism comprising an elastic element and a pin, wherein the pin is inserted into (i) the opening of the first bar and (ii) the groove of the second bar to couple the first and second bars together, wherein the elastic element is configured to move the pin from a second position to a first position in absence of a force applied to the elastic element to lock and restrict a movement of the first and second bars relative to each other when the pin is in the first position, wherein the first and second bars are movable relative to each other when the pin is moved from the first position to the second position along a length of a linear portion of the groove in response to the force applied to the elastic element while the pin is inserted into the opening of the first bar and the groove of the second bar at the second position, and wherein the elastic element is configured to exert a force on the pin in the absence of the force in a direction substantively perpendicular to a longitudinal direction of the groove between the first end and the second end.

2. The bed frame of claim 1, wherein the pin is movable from the first end of the groove to the second end of the groove to extend the second bar relative to the first bar or to extend the first bar relative to the second bar once the pin is moved into or placed in the second position.

3. The bed frame of claim 2, wherein the first end of the groove is sized and shaped to permit the pin to move between the first position and the second position.

4. The bed frame of claim 2, wherein the first end of the groove is aligned with the opening of the first bar when the first and second bar are in a locked configuration relative to each other.

5. The bed frame of claim 1, wherein the opening of the first bar or the groove of the second bar comprises an L-shaped opening or groove.

6. The bed frame of claim 1, wherein the first position and the second position are located at a same end of the groove of the second bar.

7. The bed frame of claim 1, wherein the pin is configured to move into a third position when (i) the second bar is extended relative to the first bar or (ii) the first bar is extended relative to the second bar.

8. The bed frame of claim 7, wherein the third position is located (i) along a length of the groove of the second bar or (ii) at a different end of the groove of the second bar relative to the first and second positions.

9. The bed frame of claim 1, wherein a width of the groove at the first end of the groove is greater than a width of the groove at the second end of the groove to permit a movement of the pin between the first position and the second position.

10. The bed frame of claim 1, wherein the elastic element has a spring constant that enables a movement of the pin from the second position to the first position, in absence of a force applied to the elastic element, when the pin is positioned at the first end of the groove.

11. The bed frame of claim 1, wherein the locking mechanism further comprises a connector piece through which the pin is inserted, wherein the elastic element is positioned between the connector piece and the first or second bar.

12. The bed frame of claim 11, wherein the connector piece is movable between the first position and the second position.

13. The bed frame of claim 11, wherein the pin is configured to move from the first position to the second position when the connector piece is moved towards the first or second bar.

14. The bed frame of claim 11, wherein at least one end of the pin is riveted to the connector piece.

15. The bed frame of claim 14, wherein the connector piece and the pin are configured to move together such that the pin moves from the first position to the second position when the connector piece moves towards the first or second bar.

16. The bed frame of claim 1, further comprising:

a first sub-frame coupled to a second sub-frame, wherein the first sub-frame and the second sub-frame are movable relative to each other to fold or unfold the bed frame; and a first leg assembly coupled to the first sub-frame and a second leg assembly coupled to the second sub-frame, wherein the first leg assembly and the second leg assembly each comprise a lateral support bar.

17. The bed frame of claim 1, wherein the pin moves laterally between the first position and second position along the linear portion of the groove.

18. The bed frame of claim 1, wherein the pin is configured to not move longitudinally between the first position and the second position along the linear portion of the groove.

19. The bed frame of claim 1, wherein the elastic element is configured to exert a force on the pin that is substantively perpendicular to a longitudinal axis of the pin.

20. The bed frame of claim 1, wherein the elastic element does not come into direct contact with the pin.

* * * * *